US007034767B2

(12) United States Patent
Karlsen

(10) Patent No.: US 7,034,767 B2
(45) Date of Patent: Apr. 25, 2006

(54) HELICAL COIL, MAGNETIC CORE ANTENNA

(76) Inventor: Helge Idar Karlsen, Hans og Grete stien 32, Sandnes (NO) N-4314

( * ) Notice: Subject to any disclaimer, the term of this patent is extended or adjusted under 35 U.S.C. 154(b) by 0 days.

(21) Appl. No.: 10/416,084

(22) PCT Filed: Nov. 5, 2001

(86) PCT No.: PCT/NO01/00441

§ 371 (c)(1),
(2), (4) Date: Jul. 25, 2003

(87) PCT Pub. No.: WO02/45210

PCT Pub. Date: Jun. 6, 2002

(65) Prior Publication Data

US 2005/0073466 A1 Apr. 7, 2005

(30) Foreign Application Priority Data

Nov. 6, 2000 (NO) ..... 20005604

(51) Int. Cl.
*H01Q 7/08* (2006.01)
*H01Q 1/36* (2006.01)

(52) U.S. Cl. ..... 343/788; 343/787

(58) Field of Classification Search ..... 343/895
See application file for complete search history.

(56) References Cited

U.S. PATENT DOCUMENTS

| | | | | |
|---|---|---|---|---|
| 3,513,472 | A | 5/1970 | Altmayer | |
| 4,407,000 | A | 9/1983 | Sasaki et al. | |
| 4,429,314 | A | 1/1984 | Albright | |
| 4,644,366 | A | 2/1987 | Scholz | |
| 4,712,112 | A * | 12/1987 | Carr | 343/788 |
| 4,978,966 | A | 12/1990 | Takizawa et al. | |

FOREIGN PATENT DOCUMENTS

| | | |
|---|---|---|
| DE | 33 09 405 | 9/1984 |
| JP | 55-055602 | 4/1980 |
| JP | 59-208902 | 11/1984 |
| JP | 3-227102 | 8/1991 |
| JP | 9-307327 | 11/1997 |

OTHER PUBLICATIONS

Loops and Rods, 7.4 The Ferrite Rod Antenna, four web pages, University of St. Andrews, Fife, Scotland.
The ARRL Antenna Handbook, p. 5-1, 8th Edition, 1988.
Ulf Gunnarsson, Antenner, published by Hermods, p. 7.

(Continued)

*Primary Examiner*—James Vannucci
(74) *Attorney, Agent, or Firm*—Andrus, Sceales, Starke & Sawall, LLP

(57) ABSTRACT

A device by an antenna (1) where the coil conductor (2) of the antenna is wound around a ferrite rod/tube (4), and where one conductor (12) of a connecting cable (10) is electrically coupled to one end portion (2*a*) of the coil conductor (2) of the antenna (1), and the other conductor (14) of the connecting cable (10) is electrically coupled to a connection point (2*b*), the connection point (2*b*) being located on the coil conductor (2), between the two end portions (2*a*) and (2*c*) of the coil conductor.

18 Claims, 10 Drawing Sheets

OTHER PUBLICATIONS

PCT Written Opinion of Oct. 8, 2002.
Applicant's Reply to Written Opinion of Dec. 2, 2002.
PCT Written Opinion of Dec. 6, 2002.
Applicant's Reply to Written Opinion of Dec. 30, 2002.
International Preliminary Examination Report of Jan. 22, 2003.

* cited by examiner

HELICAL COIL, MAGNETIC CORE ANTENNA

CROSS REFERENCE TO RELATED APPLICATION

The present application is the U.S. national stage application of International Application PCT/NO01/00441, filed Nov. 5, 2001, which international application was published on Jun. 6, 2002 as International Publication WO 02/45210. The International Application claims priority of Norwegian Patent Application 20005604, filed Nov. 6, 2000.

SUMMARY OF THE INVENTION

This invention regards a transmitting and receiving antenna that upon connection to a suitable device generates and/or is sensitive mainly to the magnetic part of an electromagnetic field.

Antenna theory often bases itself on a single dipole antenna, which in literature is termed a "Hertzian dipole" antenna. This type of antenna is very short relative to the wavelength of the electromagnetic field. The electromagnetic radiation of the dipole antenna is largely dependent on the direction in question, relative to the principal axis of the antenna. Thus the dipole antenna is a direction-sensitive antenna. Seen in relation to an imaginary antenna with equal radiation in all directions, the dipole antenna will for the same power input, not taking losses into account, in some directions have greater radiation than the imaginary antenna, and in other directions less radiation. The relationship between the maximum radiation intensity of the directional antenna and the uniform radiation intensity of the imaginary antenna is termed gain, and is an expression of the directional sensitivity of an antenna.

However a real antenna does not radiate all input. It is customary to view an antenna as a circuit in which an antenna resistance representing the radiated power, an ohmic resistance representing the power lost e.g. through heating of the antenna, and a reflection impedance representing the potential of the antenna to return part of the input to the transmitter connected to the antenna, are connected in series. The ohmic losses in an antenna places considerable restrictions e.g. on the use of ferrite in transmitting antennae, as overheating changes the magnetic property of the ferrite. Due to its magnetic property, ferrite is extensively used in receiving antennae.

Ever since the electromagnet field was discovered, the development of antennae has centred around improving the ratio between the types of resistance in an antenna, remedying and/or adapting its impedance to the transmitter, and adapting the antenna to the frequency range in which it is intended to operate.

An electromagnetic field comprises an electric and a magnetic field. Most known antenna are virtually pure electrical antennae in the sense that they generate/are sensitive to electrical fields. One type of antenna, the magnetic loop antenna, generates/is in principle only sensitive to the magnetic part of the electromagnetic field. Several fundamentally different versions of this type of antenna are known. One variety comprises an antenna in which many turns of the antenna conductor have been wound around a magnetic rod. Upon transmission, a magnetic field is formed, which is directed along the central axis of the winding. However this solution, which is very good per se, is not suitable for transmission due to the ohmic losses as described above, but is extensively used as an AM antenna in radio receivers, where its main disadvantage is its great directional dependency.

Antennae that are chiefly sensitive to the electrical part of the electromagnetic field are influenced by the multitude of electrical fields that surround the antenna. These fields may cause serious disturbance, e.g. to a radio circuit. A magnetic antenna is not subject to the same degree of this type of disturbance.

DETAILED DESCRIPTION OF THE INVENTION

The object of the invention is to remedy the negative aspects of prior art.

The object is achieved in accordance with the invention by the characteristics stated in the undermentioned description and in the appended claims.

In its basic configuration, the antenna comprises a coil in which one conductor of a connecting cable is connected to one end portion of the coil, and where the other conductor of the connecting cable is connected to the coil at a point between the two end portions of the coil. The number of coil windings between the two connection points must be adapted to the frequency range in which the antenna is to operate. The part of the coil which is located between the connection points constitutes the feeder part of the antenna. The remainder of the windings of the antenna, the resonant part, which forms an extension of the feeder windings, requires a number of windings sufficient to make the antenna resonant without the use of a capacitor or other tuning devices. The resonant winding is terminated in a free end; i.e. the end of the antenna wire in the basic configuration is not electrically coupled. Experiments have shown that the first windings of the resonant coil, counted from the connecting point, must have a certain mutual spacing in order to avoid heating the coil. The remainder of the resonant windings may be closely wound.

A fixed or travelling ferrite rod, or alternatively a ferrite tube, may be positioned inside the coil in parallel with the central axis of the coil. The purpose of this is to increase the antenna resistance of the antenna. By using a travelling ferrite rod, the resonant range of the antenna may be changed and matched to the frequency of the relevant electromagnetic field.

It is necessary to adapt the ferrite material to the frequency range to be covered by the antenna. In the case of relatively low frequencies, use may be made of ferrite rods such as used in medium wave receivers. In the case of higher frequencies, a ferrite rod having a lower permeability should be used, preferably one manufactured through use of powder technology. For antennae that are to operate at the highest frequencies, it has proven difficult to obtain ferrite materials of the desired permeability, probably because such materials are not in great demand. A general rule is that a higher frequency range requires the ferrite rod to have a lower magnetic permeability. When the antenna is to be used only as a receiving antenna, using the same materials as those found in a conventional ferrite rod antenna will be sufficient.

Antennae according to the invention distinguish themselves by the basic configuration exhibiting little gain; in terms of radiation pattern they are approximately isotopic, which means that they are not very direction-oriented. Low ohmic equivalent resistance allows an antenna containing a ferrite rod to be used as a transmitting antenna, also at considerable transmission power. Further, it is a great advantage that the antenna may readily be tuned without the use of special tuning circuits. Tests that have been carried out indicate that the antenna is principally a magnetic antenna. Compared with other magnetic transmitting antennae, the antenna according to the invention has a considerably smaller physical size and weight.

The basic configuration of the antenna may be modified in a number of ways in order to adapt it for special purposes.

Some examples of this have been described in the specification, in which reference is made to the accompanying drawings.

BRIEF DESCRIPTION OF THE DRAWINGS

The following describes a non-limiting example of a preferred embodiment of the basic configuration of the antenna, along with several examples of possible modifications of the antenna. The embodiments are illustrated in the accompanying drawings, in which.

DETAILED DESCRIPTION OF THE DRAWINGS

Figure 10:
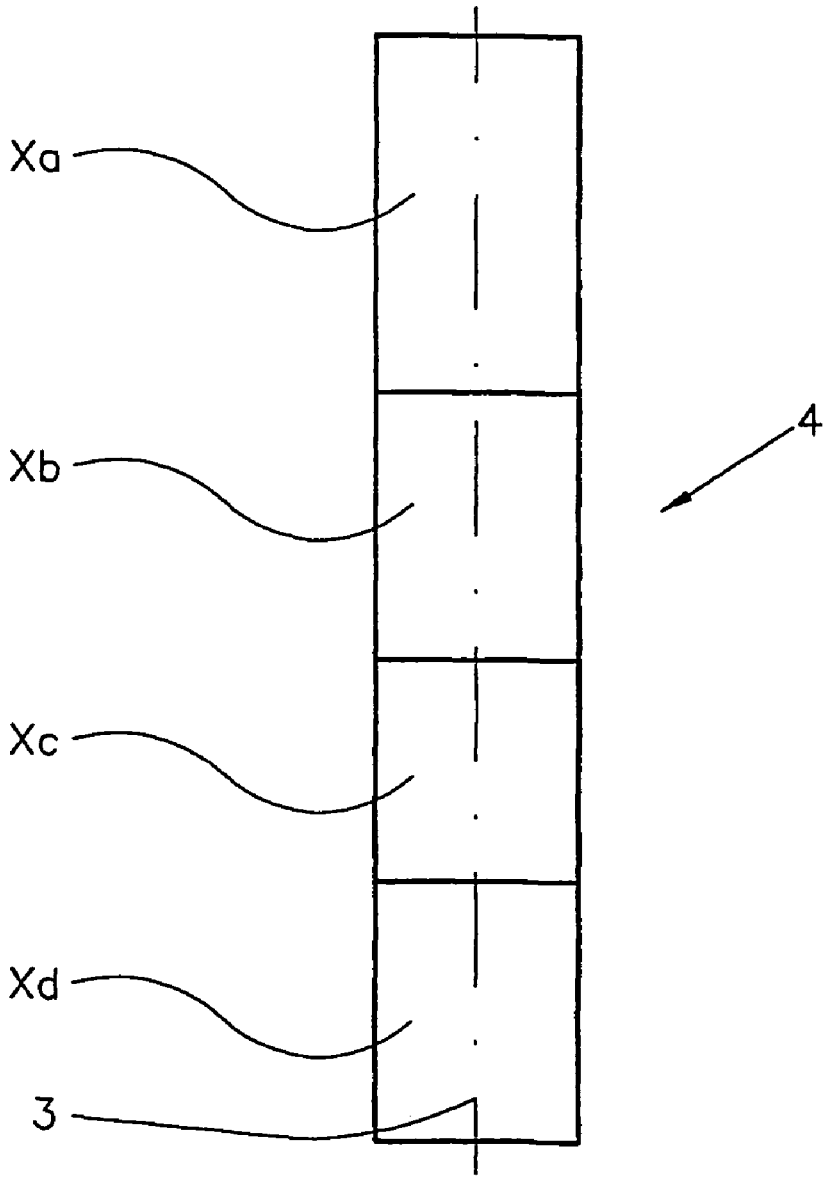
FIG. 10 shows an embodiment of the ferrite rod of the antenna in which the different sections of the ferrite rod have different permeability.

In the drawings, reference number 1 denotes an antenna according to the invention, comprising a coil conductor 2 surrounding a fixed or travelling ferrite rod 4. One conductor 12 of a connection line 10 connected to a transmitter or receiver (not shown) is electrically coupled to one end portion 2*a* of the coil 2. The other conductor 14 of the connection line 10 is electrically coupled to a point 2*b* on coil conductor 2, the point 2*b* being located somewhere between the two end portions 2*a* and 2*c* of the coil conductor. In this basic configuration, the end portion 2*c* is not electrically coupled. The coil portion located between the points 2*a* and 2*b* constitutes the feeder part of the antenna 1, while the coil portion located between points 2*b* and 2*c* constitutes the resonant part of the antenna 1. The antenna 1 will also function without using the ferrite rod 4. The ferrite rod 4 may comprise one or more ferrite sections Xa, Xb, Xc and Xd, possibly with different shapes and permeabilities, see FIG. 10, and possibly with intermediate or connected-up sections made from one or more other materials.

By displacing the ferrite rod 4 along the central axis 3 of the coil 1 in the direction of the feeder point 2*a*, part of the coil conductor 2 falls outside the ferrite rod 4. Thus the resonant frequency of the antenna is changed, allowing the antenna to be adapted to a different frequency range.

Figure 1:
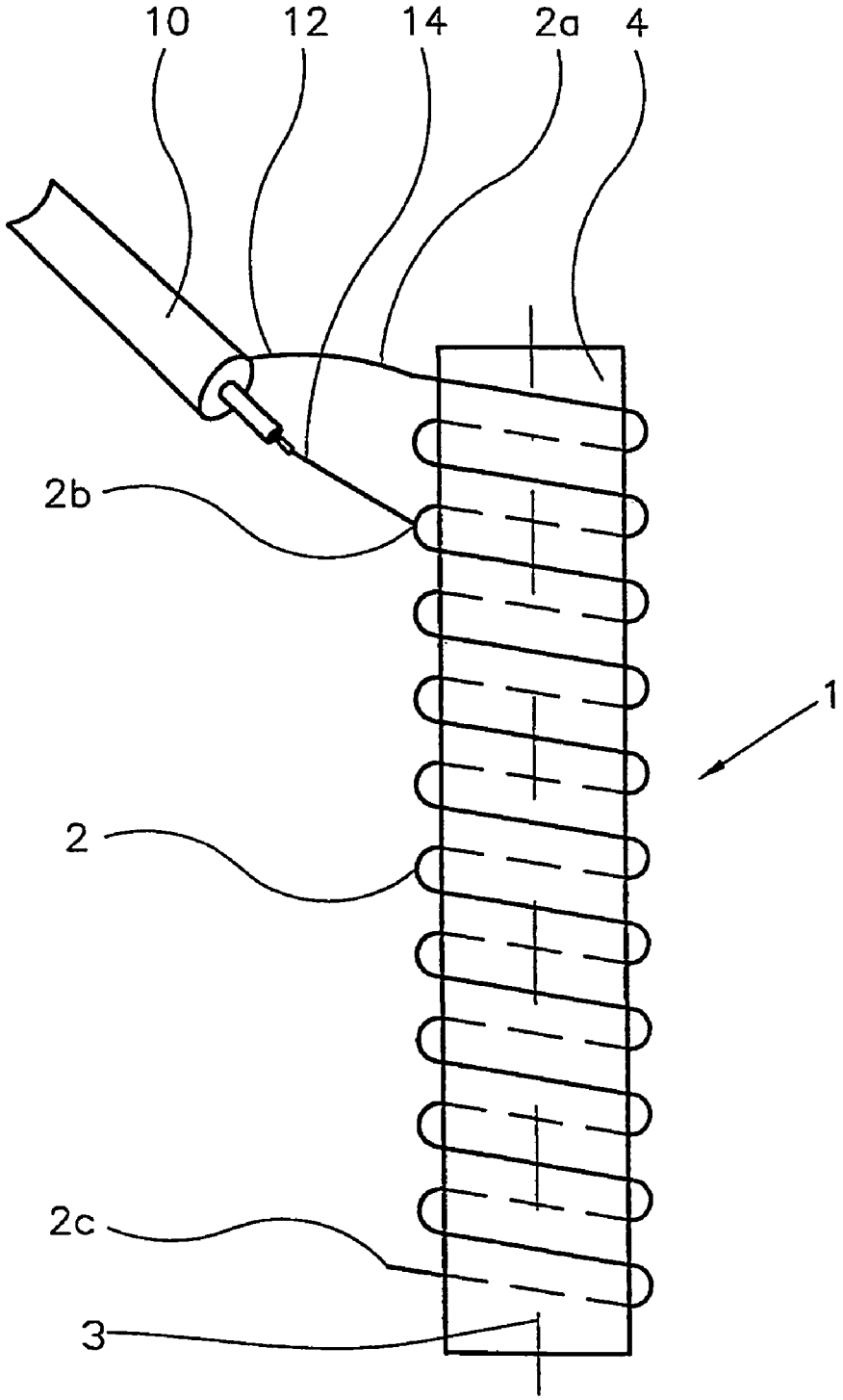
FIG. 1 schematically shows the basic configuration of the antenna.
Figure 2:
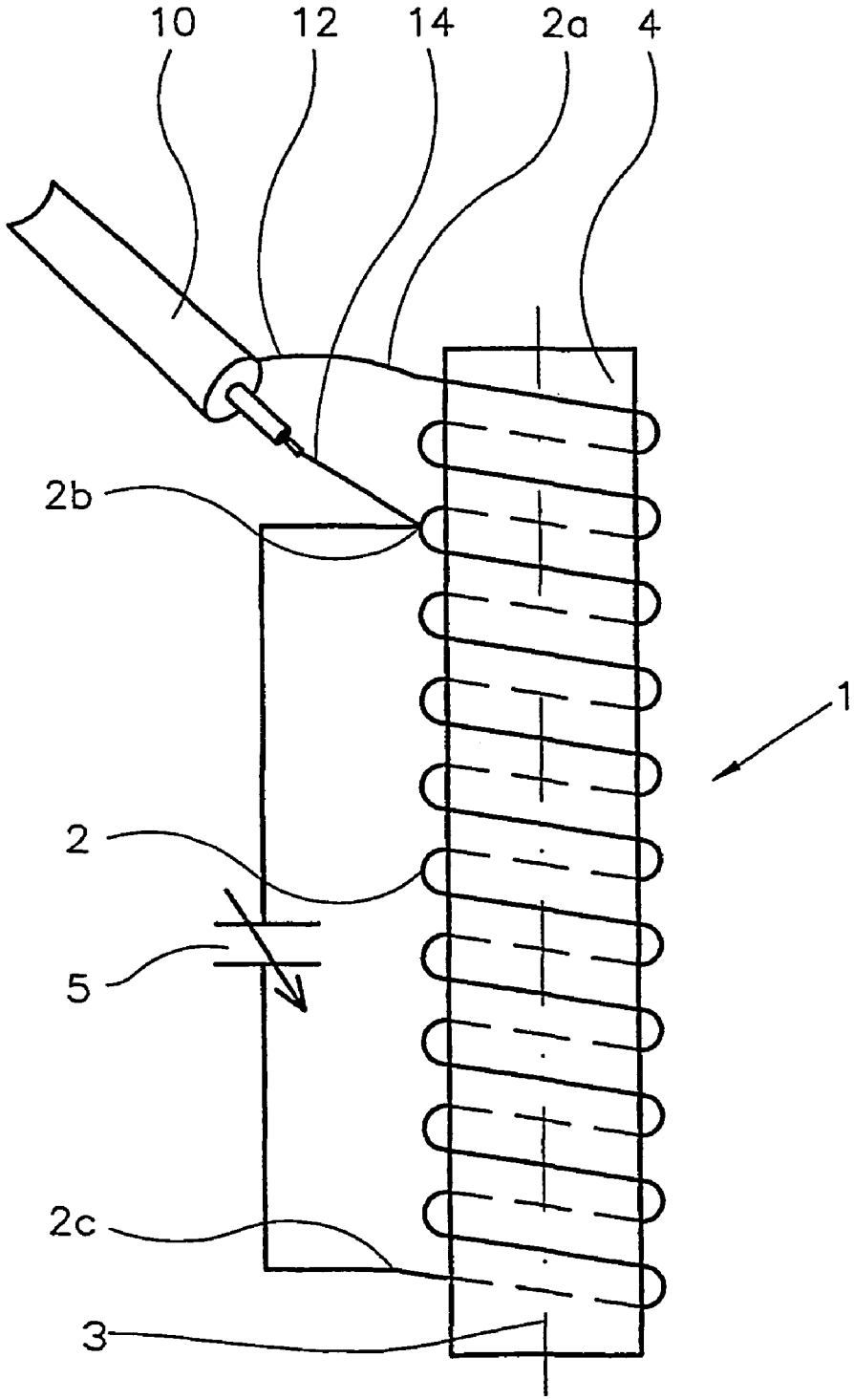
FIG. 2 schematically shows the antenna of FIG. 1 with a connected tuning capacitor.
Figure 3:
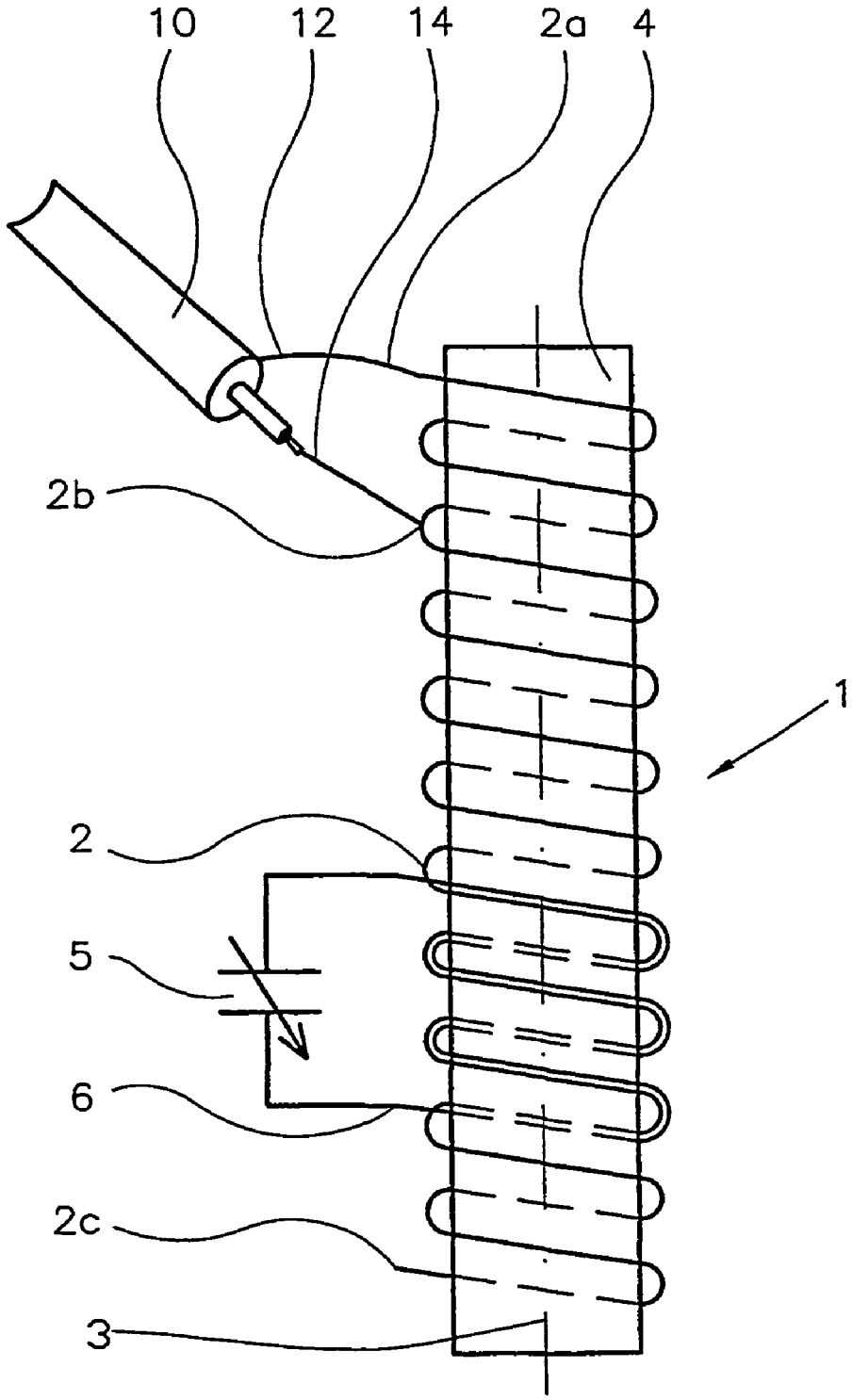
FIG. 3 schematically shows the antenna of FIG. 1 with a tuning capacitor and a separate coil wound by the resonant part of the antenna.
Figure 4:
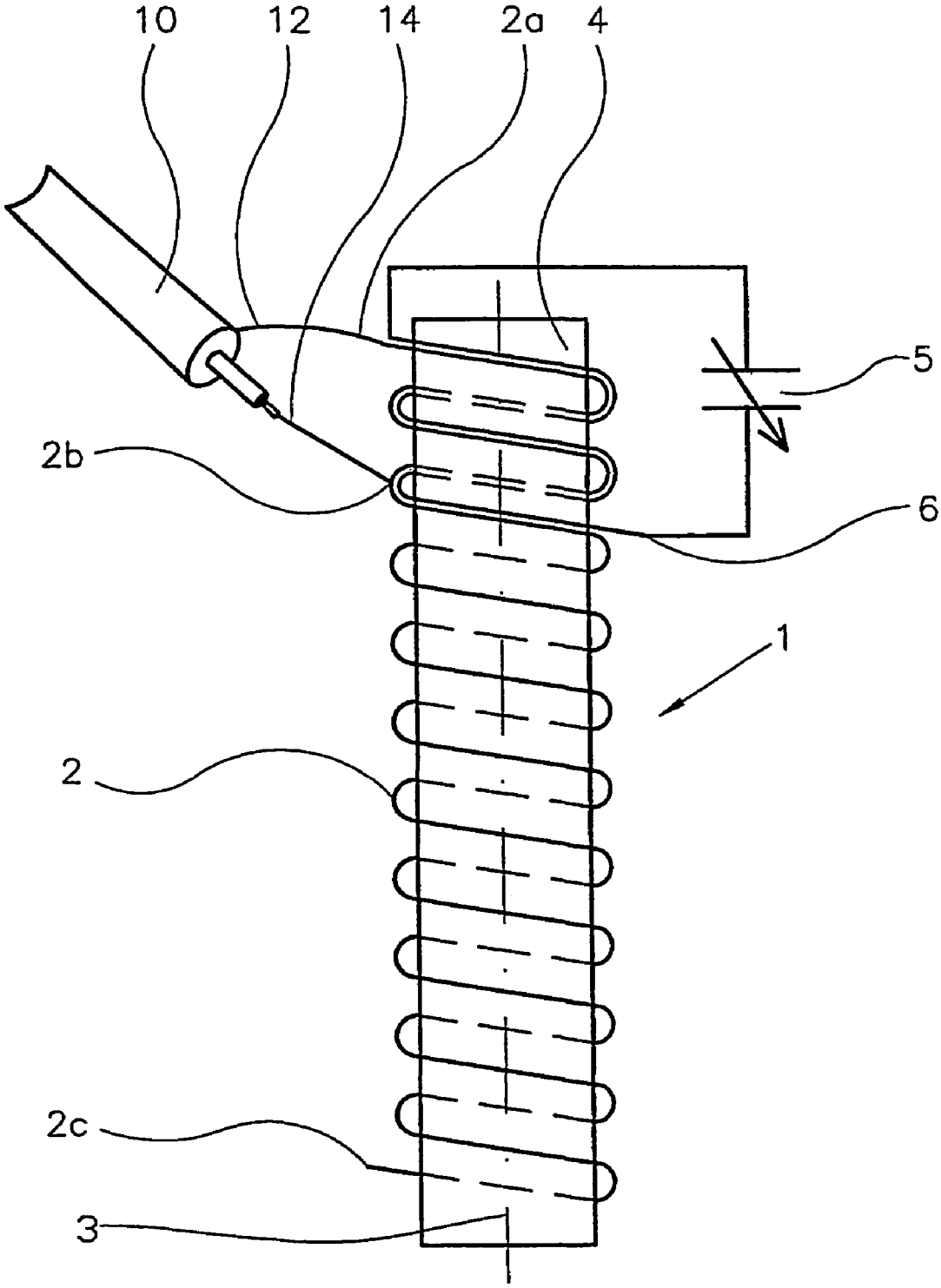
FIG. 4 schematically shows the antenna of FIG. 1 with a tuning capacitor and a separate coil wound by the feeder part of the antenna.
Figure 5:
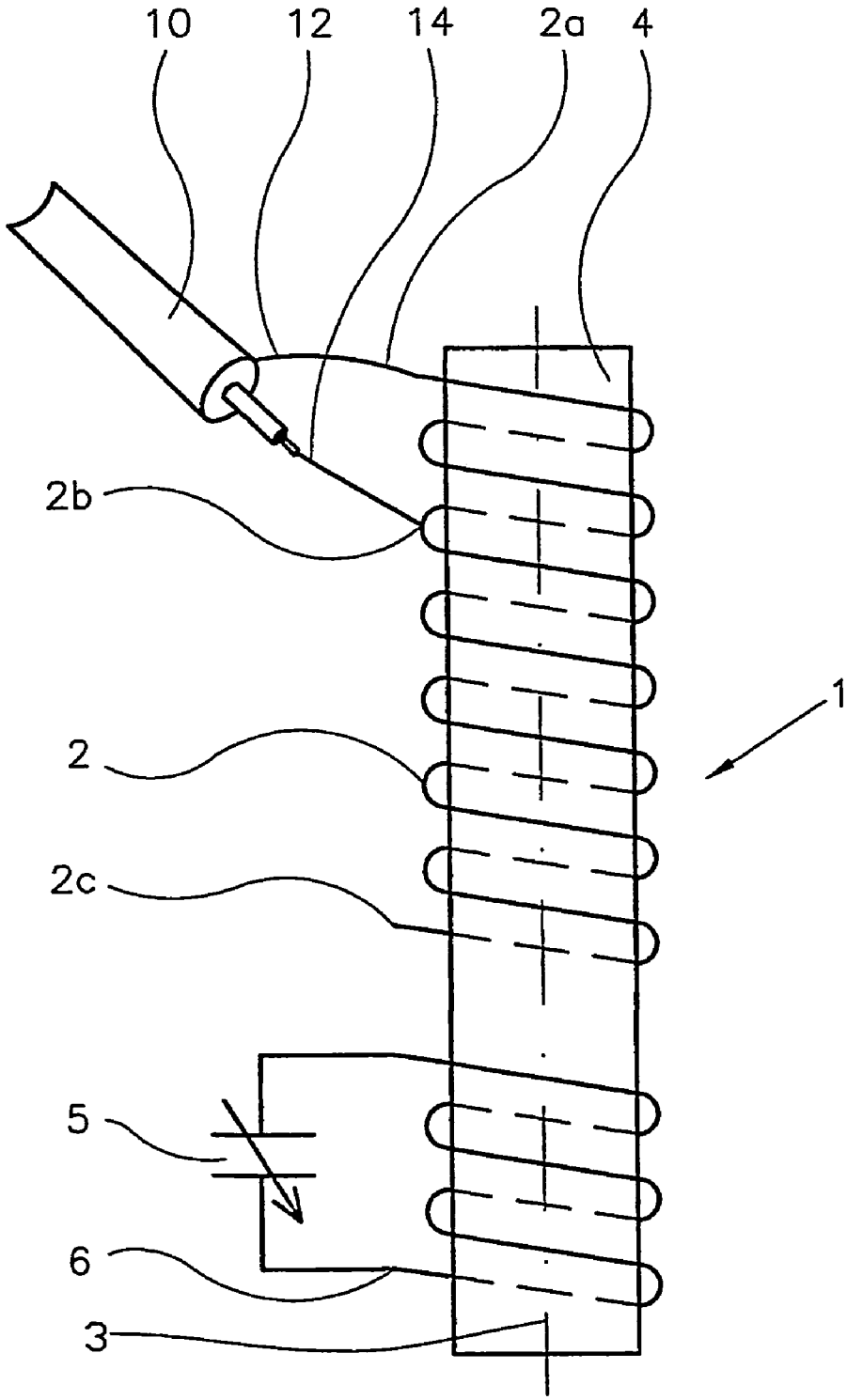
FIG. 5 schematically shows the antenna of FIG. 1 with a tuning capacitor and a separate coil wound next to the antenna coil.
Figure 6:
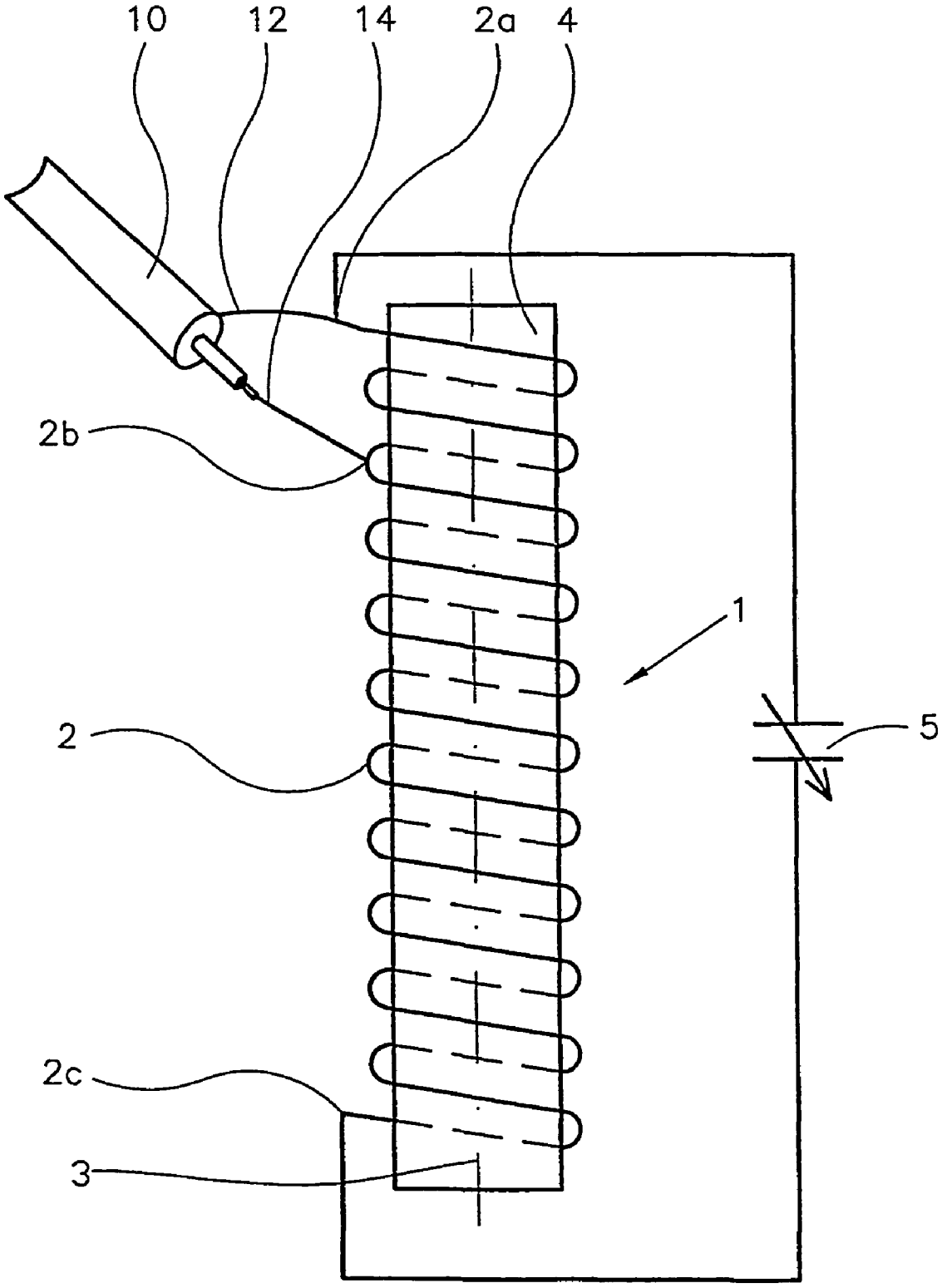
FIG. 6 schematically shows the antenna of FIG. 1 with a tuning capacitor connected to the two end portions of the coil conductor.

In an embodiment with a fixed ferrite rod 4 it is possible to tune the antenna by means of a capacitor 5 connected to the points 2*b* and 2*c*, see FIG. 2. FIGS. 2 to 8 all show alternative embodiments designed to tune the antenna 1. In FIG. 3, the capacitor 5 is inductively coupled to the antenna 1 by means of a coil 6. The coil 6 may be wound between or over the coil conductor 2. It is important to the operation of the circuit that the coils 2 and 6 be wound in the same direction. The advantage of the circuit as shown in FIG. 3 is that the capacitor voltage is relatively low, allowing the use of a capacitor 5 with small spacing between the plates. In FIG. 4, the coil 6 is positioned by the feeder part of the antenna 1. In this embodiment it is also important that the coils 2 and 6 be wound in the same direction. In FIG. 5, the coil 6 is wound to encircle the ferrite rod next to the coil conductor 2. In FIG. 6, the capacitor is connected between the end portions 2*a* and 2*c* of the coil.

Figure 7:
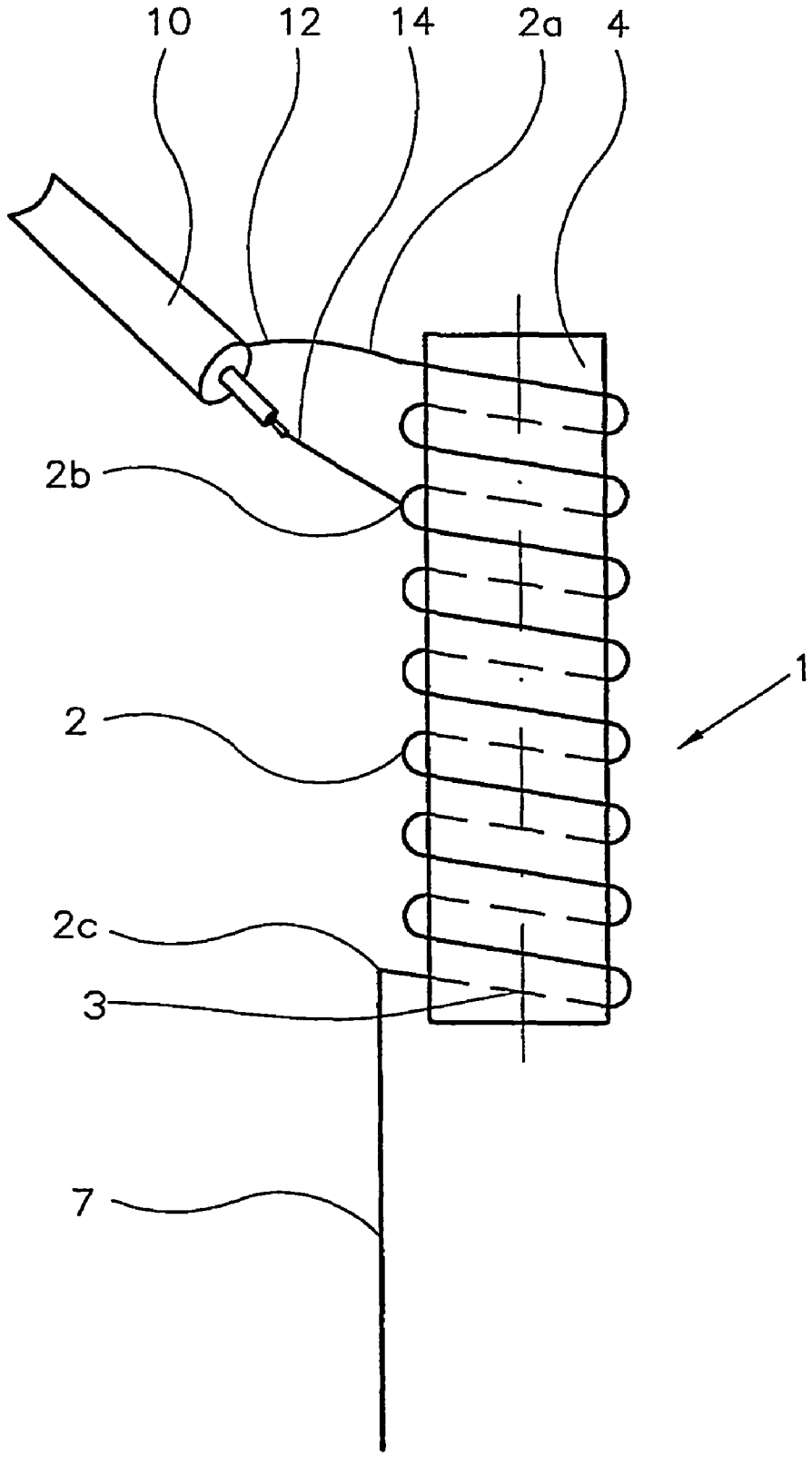
FIG. 7 schematically shows the antenna of FIG. 1 with a conductor connected to the free end portion of the coil conductor.

FIG. 7 shows an embodiment in which a conventional conductor 7 is connected to the end portion 2*c* of the coil conductor 2, and where the length of the conductor 7 may be used to tune the antenna 1, either by merely changing the length of the conductor 7 or in combination with making the coil 2 resonate, either by means of a capacitor 5 as shown in the preceding drawings or by moving the ferrite rod 4 in or out of the coil 2.

Figure 8:
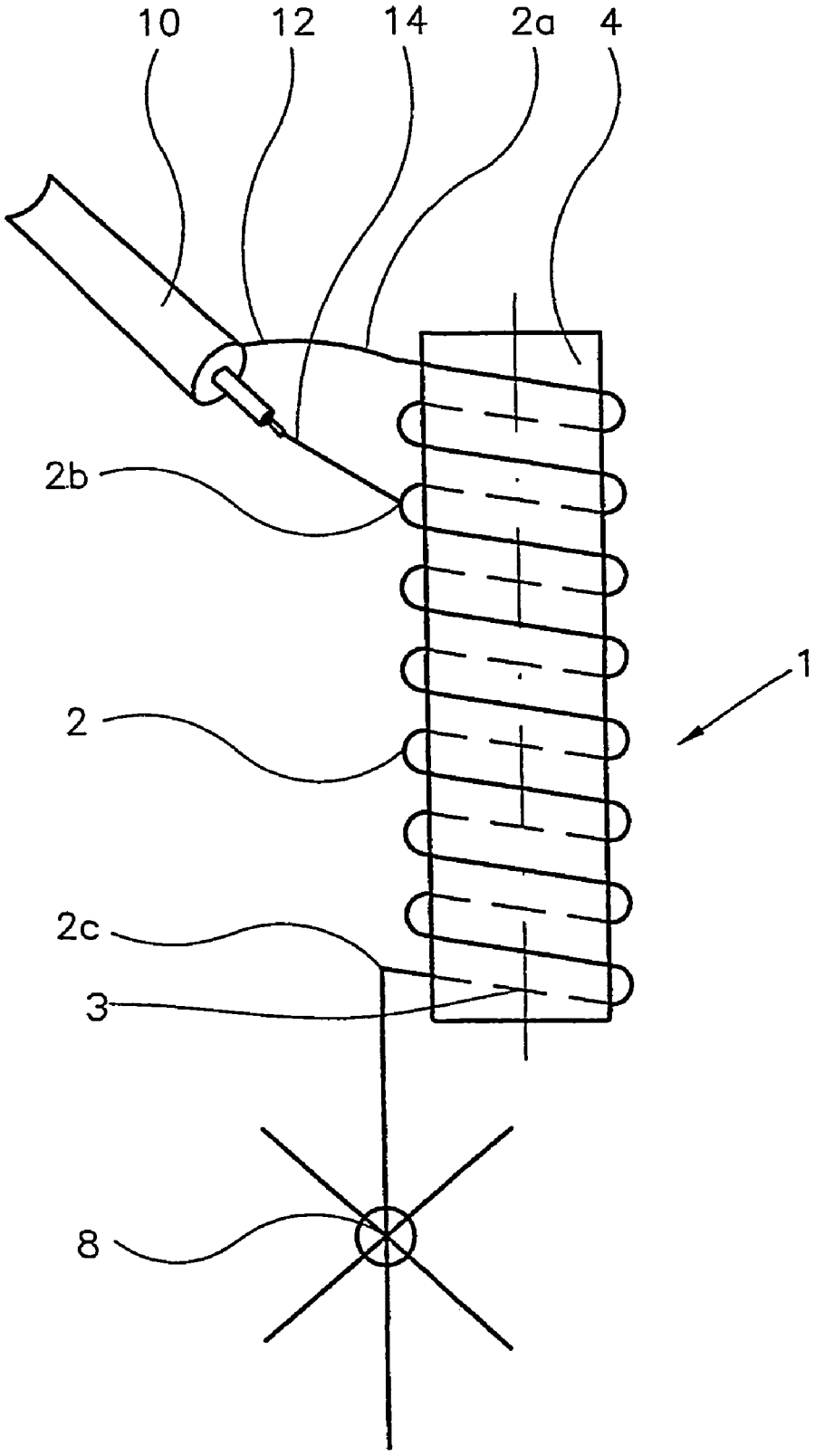
FIG. 8 schematically shows the antenna of FIG. 1 with a capacitance cap connected to the free end portion of the coil conductor.
Figure 9:
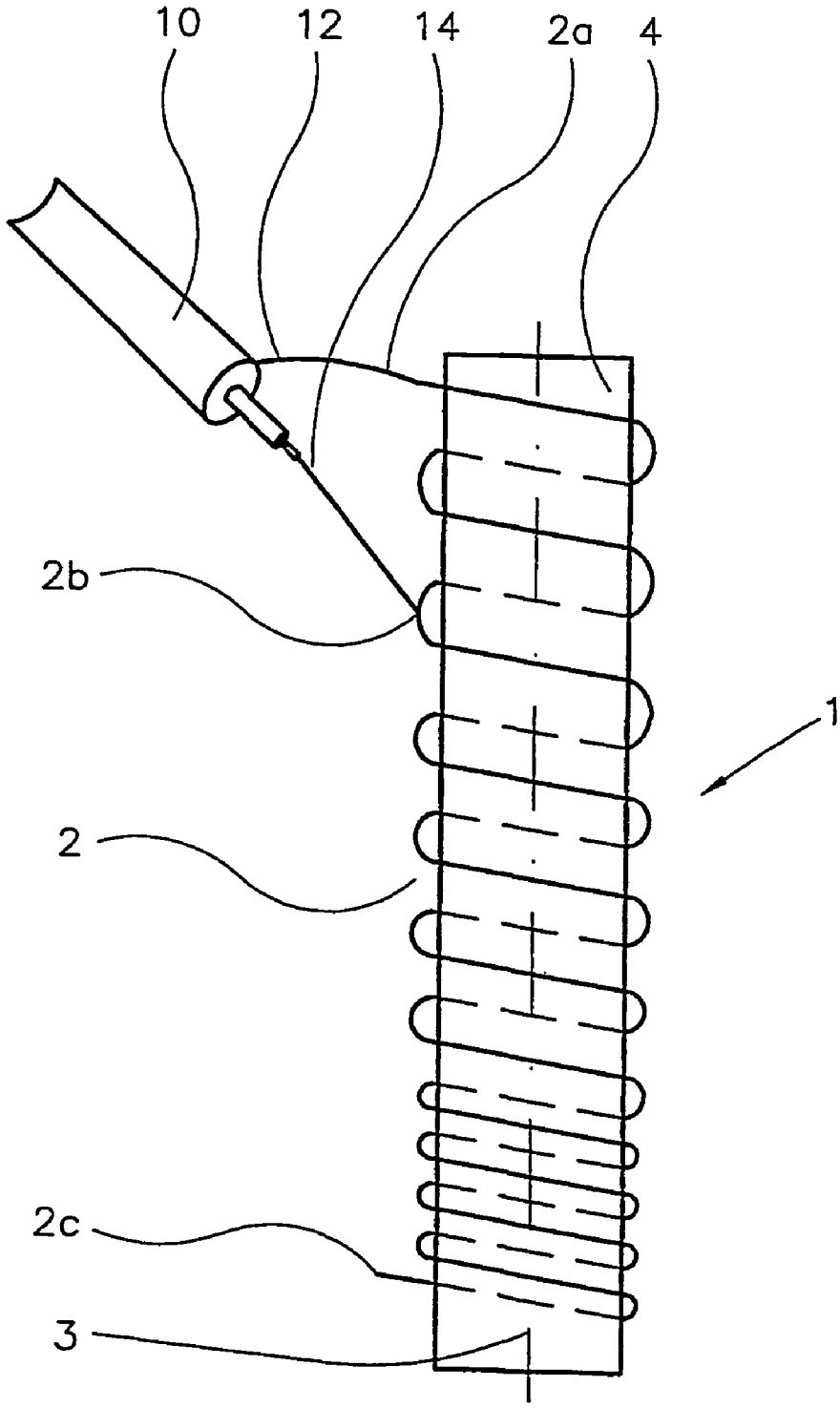
FIG. 9 schematically shows the antenna of FIG. 1, where the pitch of the coil windings varies.

In FIG. 8, the end portion 2*c* of the coil conductor 2 is connected to a capacitance cap 8. This embodiment is particularly suitable when it is desirable for the antenna not to take up a lot of space. Resonance may be produced as described for FIG. 7.

Two or more of the embodiments shown may be combined in order to adapt the antenna for special purposes.

The invention claimed is:

1. An antenna for an electromagnetic field comprising:

a ferrite core (4); and a conductor (2) helically wound around said ferrite core (4) to form a coil, said conductor having a first end portion (2*a*) at one end of said coil and a second end portion (2*c*) at the other end of said coil, said conductor having a connection portion forming a connection point (2*b*) in said coil intermediate said end portions (2*a*, 2*c*) of said conductor, said first end portion (2*a*) of said conductor being suitable for connection to one conductor (12) of an antenna connecting cable (10), said connection point (2*b*) being suitable for connection to another conductor (14) of the antenna connecting cable (10); and said second end portion (2*c*) of said conductor is a free and unconnected end of said coil.

2. The antenna of claim 1 wherein said core is comprised of one of a ferrite rod or tube.

3. The antenna of claim 1 wherein said core is formed from powder ferrite material.

4. The antenna according to claim 1 wherein the magnetic permeability of said ferrite core varies along its length.

5. The antenna according to claim 1 wherein said ferrite core is formed of sections.

6. The antenna according to claim 5 wherein said sections have differing magnetic permeabilities.

7. The antenna according to claim 5 wherein said sections have differing shapes.

8. The antenna according to claim 5 wherein said core includes sections of ferrite material and sections of another material.

9. The antenna according to claim 1 wherein said ferrite core is fixed with respect to said coil.

10. The antenna according to claim 1 wherein said core is movable with respect to said coil.

11. The antenna according to claim 1 wherein the number of turns of said coil between said first end portion (2*a*) and said connection point (2*b*) is selected in accordance with the frequency range in which the antenna is to operate.

12. The antenna according to claim 1 wherein the number of turns in said coil between said connecting point (2*b*) and said second end portion (2*c*) is sufficient to render said antenna resonant.

13. The antenna according to claim 1 wherein spacing between turns of said coil varies along the length of said coil.

14. The antenna according to claim 12 wherein spacing between turns in the portion of said coil between said connecting point (2*b*) and said free end vary along the length of said portion of said coil.

15. The antenna according to claim 12 wherein the turns in the portion of said coil that are between said connecting point and said free end and that are adjacent said connecting point are spaced sufficiently to avoid heating of the coil.

16. The antenna according to claim 1 further including capacitive tuning means coupled between said first end portion (2*a*) and said connecting point (2*b*) of said coil.

17. The antenna according to claim 1 further including capacitive tuning means separately coupled to said ferrite core.

18. The antenna according to claim 1 further including capacitive tuning means inductively coupled to said coil.

* * * * *